United States Patent [19]

Vanier

[11] Patent Number: 4,866,028

[45] Date of Patent: Sep. 12, 1989

[54] SLIPPING LAYER CONTAINING ACYLOXY-TERMINATED SILOXANE FOR DYE-DONOR ELEMENT USED IN THERMAL DYE TRANSFER

[75] Inventor: Noel R. Vanier, Rochester, N.Y.

[73] Assignee: Eastman Kodak Company, Rochester, N.Y.

[21] Appl. No.: 214,364

[22] Filed: Jul. 1, 1988

[51] Int. Cl.[4] ..... B41M 5/035; B41M 5/26

[52] U.S. Cl. ..... 503/227; 8/471; 428/195; 428/341; 428/447; 428/480; 428/913; 428/914

[58] Field of Search ..... 8/471; 427/146, 256; 428/195, 207, 447, 480, 913, 914; 430/945; 503/227

[56] References Cited

U.S. PATENT DOCUMENTS 4,738,950 4/1988 Vanier et al. ..... 503/227

*Primary Examiner*—Bruce H. Hess

*Attorney, Agent, or Firm*—Harold E. Cole

[57] ABSTRACT

A dye-donor element for thermal dye transfer comprising a support having on one side thereon a dye layer and on the other side a slipping layer, said slipping layer comprising a linear or branched acyloxy-terminated poly(dialkyl, diaryl or alkylaryl siloxane).

20 Claims, No Drawings

SLIPPING LAYER CONTAINING ACYLOXY-TERMINATED SILOXANE FOR DYE-DONOR ELEMENT USED IN THERMAL DYE TRANSFER

This invention relates to dye-donor elements used in thermal dye transfer, and more particularly to the use of a certain polysiloxane slipping layer on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the two other colors. A color hard copy is thus obtained which corresponds to the original picture viewed on a screen. Further details of this process and an apparatus for carrying it out are contained n U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head. The dye transferred thus does not appear as a uniform area, but rather as a series of alternating light and dark bands (chatter marks).

Another defect called "smiles", which are crescent shaped low density areas, is produced in the receiving element by stretch-induced folds in the dye-donor.

Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing.

Another defect called "pops" occurs when printing images that have lines or edges parallel to the heat-line of the print head. This results in a significant number of heater elements across the head changing from hot to cold at the same time. These sudden hot to cold transitions may result in sticking of the thermal head to the donor and a jerking motion. The jerking motion causes skipped printing lines and misregistration of the image usually results. At times, the release of this sticking may be so severe as to create a popping noise, or "pops". It would be desirable to eliminate or lessen the above such problems in order to have a commercially acceptable system.

U.S. Pat. No. 4,738,950 of Vanier and Evans, issued Apr. 19, 1988, relates to the use of particular amino-modified silicone materials for use as a slipping layer in thermal dye transfer systems. While this material has been good in many respects, any improvement in lessening any of the above problems would be highly desirable. As will be shown by comparative tests hereinafter, the slipping layer of the invention has improved lubricity resulting in minimized "pops".

Accordingly, this invention relates to a dye-donor element for thermal dye transfer comprising a support having on one side thereof a dye layer and on the other side a slipping layer, and wherein the slipping layer comprises a linear or branched acyloxy-terminated poly(dialkyl, diaryl or alkylaryl siloxane).

Any polysiloxane can be employed in the slipping layer of the invention provided it contains a linear or branched acyloxy-terminated poly(dialkyl, diaryl or alkylaryl siloxane). In a preferred embodiment of the invention, the polysiloxane has the formula:

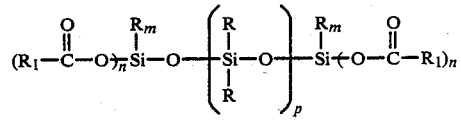

wherein n is an integer of from 1 to 3;

m is an integer of from 0 to 2;

n+m=3;

p is from about 10 to about 2000;

each R is independently a substituted or unsubstituted alkyl group having from 1 to about 18 carbon atoms, such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; or a substituted or unsubstituted aryl group having from about 6 to about 10 carbon atoms, such as phenyl, pyridyl, naphthyl, p-tolyl, p-chlorophenyl, m-(N-methyl sulfamoyl)phenyl, etc.; and each $R_1$ is independently a substituted or unsubstituted alkyl group having from 1 or about 7 carbon atoms, such as methyl, ethyl, propyl, isopropyl, n-butyl, t-butyl, s-butyl, n-pentyl, n-hexyl, 3-hexyl, methoxyethyl, benzyl, 2-methanesulfonamidoethyl, 2-hydroxyethyl, 2-cyanoethyl, methoxycarbonylmethyl, etc.; or a substituted or unsubstituted aryl group having from about 6 to about 10 carbon atoms such as those listed above for R.

In another preferred embodiment of the invention, the polysiloxane is a methyldiacetoxy-terminated polydimethylsiloxane, such as one having the formula:

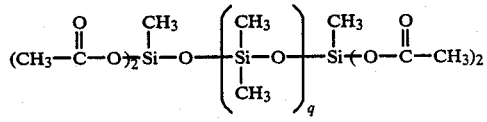

wherein q is from about 10 to about 2000, having a molecular weight of about 36,000. This material is supplied commercially from Petrarch Systems, Inc. Bartram Rd. Bristol, Pennsylvania 19007 as PS368.5 ®.

In still another preferred embodiment of the invention, the polysiloxane is a methylmonoacetoxy-terminated polydimethylsiloxane, such as one having the formula:

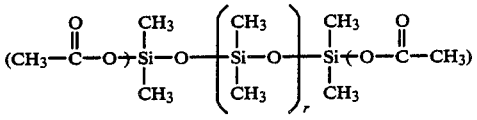

wherein r is from about 10 to about 2000, having a molecular weight of about 36,000. This material is supplied commercially from Petrarch Systems, Inc. Bartram Rd. Bristol, Pennsylvania 19007 as PS363.5®.

The polysiloxane may be present in any amount which is effective for the intended purpose. In a preferred embodiment of the invention, the polysiloxane is present in an amount of from about 0.0005 to about 0.05 g/m$^2$.

A polymeric binder may also be used in the slipping layer of the invention. In a preferred embodiment, thermoplastic binders are employed. Examples of such materials include, for example, poly(styrene-co-acrylonitrile) (70/30 wt. ratio); poly(vinyl alcohol-co-butyral) (available commercially as Butvar 76® by Dow Chemical Co.; poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; bisphenol-A polycarbonate resins; cellulose triacetate; poly(methylmethacrylate); copolymers of methyl methacrylate; poly(styrene-co-butadiene), etc. In a preferred embodiment of the invention, the thermoplastic binder is cellulose acetate propionate.

When the above siloxane material is coated in a polymeric binder, certain reactions may take place. The siloxane may react with moisture and the acyloxy groups may be hydrolyzed off. In addition, the siloxane groups may react with each other or with a hydroxyl group from the binder to give a cross-linked silicone.

When a polymeric binder is used in the slipping layer of the invention, the amount is not critical. In general, the polymeric binder may be employed in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayolon Polyol Brilliant Blue BM®, Kayaton Polyol Dark Blue 2BM®, and KST Black KR® (products of Noppin Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R° (product of Nippon Kayaku Co. Ltd.); basic dyes such as Sumicacryl Blue6G® (product of Sumitomo Chemical Co., Ltd.), and Aizen Malachite Green® (product of Hodogaya Chemical Co., Ltd.);

(magenta)

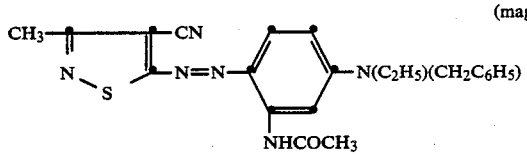

(yellow)

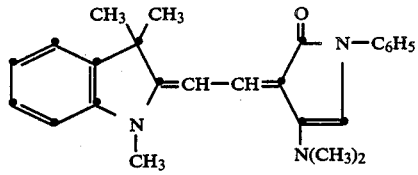

(cyan)

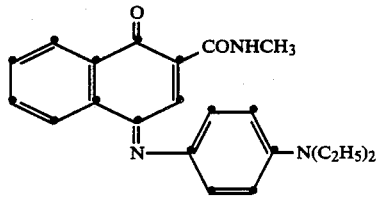

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. application Ser. No. 079,613 of Henzel, filed July 30, 1987.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1987; 095,796 of Evans and Weber, filed Sep. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A cyan dye-donor element was prepared by coating on a 6 μm poly(ethylene terephthalate) support:

(1) a subbing layer of a titanium alkoxide (duPont Tyzor TBT®) (0.12 g/m$^2$) from a n-propyl acetate and n-butyl alcohol solvent mixture, and (2) a dye layer containing the cyan dye illustrated above (0.28 g/m$^2$) and Micropowders, Inc. Fluo-HT® micronized polytetrafluoroethylene (0.05 g/m$^2$), in a cellulose acetate propionate (2.5% acetyl, 45% propionyl) binder (0.44 g/m$^2$) coated from a toluene, methanol and cyclopentanone solvent mixture.

On the back side of the dye-donor was coated:

(1) a subbing layer of a titanium alkoxide (duPont Tyzor TBT®) (0.12 g/m$^2$) coated from a n-propyl acetate and n-butyl alcohol solvent mixture, and (2) a slipping layer of Petrarch Systems Inc. PS368.5® methyl diacetoxy-terminated polysiloxane or PS363.5® dimethyl acetoxy-terminated polysiloxane identified above or the control materials identified below at either 0.016 or 0.032 g/m$^2$ in a cellulose acetate propionate binder (2.5% acetyl, 45% propionyl) (0.54 g/m$^2$) coated from a toluene and 3-pentanone solvent mixture.

Control Lubricants

Carnauba wax (Kodak L&R Products)

Bees wax (Kodak L&R Products)

Paraffin wax (mp 63° C.) (Fisher Scientific)

Petrolatum (Kodak L&R Products)

Mineral oil (Kodak L&R Products)

Micronized polyethylene particles (S-395N5® Shamrock Technologies Inc.), average particle size 12.5 μm and m.p. 125° C.

Micronized polyethylene wax (MPP-620XF® from Micro Powders Inc.), average particle size 2 μm and melting point of 116° C.

Micronized blend of polyethylene and carnauba waxes (S-232® Shamrock Technologies), 5 μm avg. particle size Erucylerucamide (an amide wax) (Humko-Sheffield Co. Kemamide E-221®)

Polydimethylsiloxane (PS-043® Petrarch Systems, Inc.)

Aminopropyldimethyl-terminated polydimethylsiloxane (PS513® Petrarch Systems, Inc.)

A dye-receiving element was prepared by coating the following layers in the order recited on a titanium dioxide-pigmented polyethylene-overcoated paper stock which was subbed with a layer of poly(acrylonitrile-covinylidene chloride-co-acrylic acid) (14:79:7 wt. ratio) (0.08 g/m$^2$) coated from 2-butanone:

(1) Dye-receiving layer of Makrolon 5705® (Bayer AG Corporation) polycarbonate resin (2.9 g/m$^2$), Tone PCL-300® polycaprolactone (Union Carbide) (0.38 g/m$^2$), and 1,4-didecoxy-2,6-dimethoxyphenol (0.38 g/m$^2$) coated from methylene chloride; and (2) Overcoat layer of Tone PCL-300® polycaprolactone (Union Carbide) (0.11 g/m$^2$), FC-431® surfactant (3M Corp.) (0.016 g/m$^2$) and DC-510® Surfactant (Dow Corning) (0.016 g/m$^2$) coated from methylene chloride.

The dye side of the dye-donor element strip approximately 10 cm33 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A test pattern of alternating D-max and D-min bars, 1.5 mm in width, was generated by varying the number of pulses/dot from 0 to 255. The voltage supplied to the print head was approximately 23.5 volts, resulting in an instantaneous peak power of 1.3 watts/dot and a maximum total of 9.6 mjoules/dot.

As each "test pattern" of alternating density bars was being generated, the force required for the pulling device to draw the assemblage between the print head and roller was measured using a Himmelstein Corp. 3-08TL(16-1) Torquemeter® (10 inch-lb. range) and 6-205 Conditioning Module ®. The force was tabulated at the edge of the passage from a D-max area to a D-min area. A low force at this boundary is desirable to minimize "pops" and misregistration. The lower the force, the better. The following results were obtained:

TABLE

| Slipping Layer Lubricant | g/m$^2$ | Force (lbs) |
|---|---|---|
| Controls | | |
| Carnauba wax | 0.016 | 4.7 |
| Carnauba wax | 0.032 | 2.0 |
| Bees wax | 0.016 | 6.4 |
| Bees wax | 0.032 | 6.4 |
| Paraffin wax | 0.016 | * |
| Paraffin wax | 0.032 | * |
| Petrolatum | 0.016 | * |
| Petrolatum | 0.032 | * |
| Mineral oil | 0.016 | * |
| Mineral oil | 0.032 | * |
| Polyethylene particles | 0.016 | * |
| Polyethylene particles | 0.032 | * |
| Polyethylene wax | 0.016 | * |
| Polyethylene wax | 0.032 | * |
| Polyethylene and carnauba wax | 0.016 | 5.1 |
| Polyethylene and carnauba wax | 0.032 | 3.1 |
| Erucylerucamide | 0.016 | * |
| Erucylerucamide | 0.032 | * |
| Polydimethylsiloxane | 0.016 | * |
| Polydimethylsiloxane | 0.032 | * |
| Amino-terminated polysiloxane | 0.016 | 2.3 |
| Amino-terminated polysiloxane | 0.032 | 1.5 |
| Invention | | |
| Diacetoxy-terminated polysiloxane | 0.016 | 0.9 |
| Diacetoxy-terminated polysiloxane | 0.032 | 0.9 |
| Acetoxy-terminated polysiloxane | 0.016 | 0.9 |

*Stuck upon passage through the thermal print head.

The above results indicate that the slipping layer according to the invention gave superior performance as compared to other lubricants.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer, the improvement wherein said slipping layer comprises a linear or branches acyloxy-terminated poly(dialkyl, diaryl or alkylaryl siloxane).

2. The element of claim 1 wherein said polysiloxane has the formula:

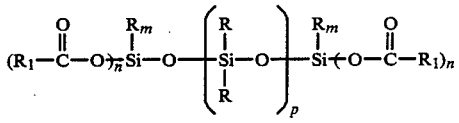

wherein n is an integer of from 1 to 3;

m is an integer of from 0 to 2;

n+m=3 p is from about 10 to about 2000; each R is independently a substituted or unsubstituted alkyl group having from 1 to about 18 carbon atoms or a substituted or unsubstituted aryl group having from about 6 to about 10 carbon atoms; and each $R_1$ is independently a substituted or unsubstituted alkyl group having from 1 to about 7 carbon atoms or a substituted or unsubstituted aryl group having from about 6 to about10 carbon atoms.

3. The element of claim 1 wherein said siloxane is a methyldiacetoxy-terminated polydimethylsiloxane.

4. The element of claim 3 wherein said polysiloxane has the formula:

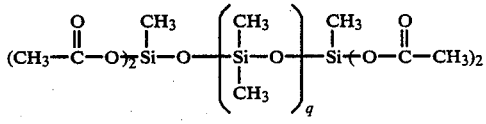

wherein q is from about 10 to about 2000.

5. The element of claim 1 wherein said siloxane is a methylmonoacetoxy-terminated polydimethylsiloxane.

6. The element of claim 5 wherein said polysiloxane is a methylmonoacetoxy-terminated polydimethylsiloxane having the formula:

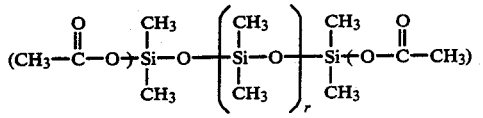

wherein r is from about 10 to 2000.

7. The element of claim 1 wherein said polysiloxane is present in an amount of from about 0.0005 to about 0.05 g/m$^2$ coated from a thermoplastic binder.

8. The element of claim 7 wherein said thermoplastic binder is cellulose acetate propionate.

9. In a process of forming a dye transfer image comprising (a) imagewise-heating a dye-donor element comprising a support having on one side thereof a dye layer and on the other side a slipping layer comprising a lubricating material, and (b) transferring a dye image to a dye-receiving element to form said dye transfer image, the improvement wherein said slipping layer comprises a linear or branched acyloxy-terminated poly(dialkyl, diaryl or alkylaryl siloxane).

10. The process of claim 9 wherein said polysiloxane has the formula:

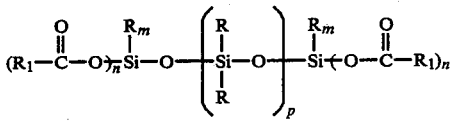

wherein n is an integer of from 1 to 3;

m is an integer of from 0 to 2;

n+m=3;

p is from about 10 to about 2000;

each R is independently a substituted or unsubstituted alkyl group having from 1 to about 18 carbon atoms or a substituted or unsubstituted aryl group having from about 6 to about 10 carbon atoms; and each $R_1$ is independently a substituted or unsubstituted alkyl group having from 1 to about 7 carbon atoms or a substituted or unsubstituted aryl group having from about 6 to about 10 carbon atoms.

11. The process of claim 9 wherein said siloxane is a methyldiacetoxy-terminated polydimethylsiloxane.

12. The process of claim 11 wherein said polysiloxane has the formula:

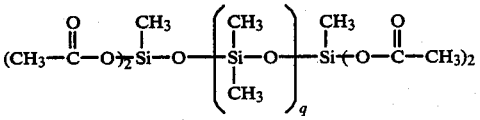

wherein q is from about 10 to about 2000.

13. The process of claim 9 wherein said polysiloxane is present in an amount of from about 0.0005 to about 0.05 g/m$^2$ coated from a thermoplastic binder.

14. The process of claim 13 wherein said thermoplastic binder is cellulose acetate propionate.

15. The process of claim 9 wherein said support is poly(ethylene terephthalate) which is coated with sequential repeating areas of cyan, magenta and yellow dye, and said process steps are sequentially performed for each color to obtain a three-color dye transfer image.

16. In a thermal dye transfer assemblage comprising:

(a) a dye-donor element comprising a support having on one side thereof a dye layer and on the other side a slipping layer comprising a lubricating material, and (b) a dye-receiving element comprising a support having thereon a dye image-receiving layer, said dye-receiving element being in a superposed relationship with said dye-donor element so that said dye layer is in contact with said dye image-receiving layer, the improvement wherein said slipping layer comprises a linear or branched acyloxy-terminated poly(dialkyl, diaryl or alkylaryl siloxane).

17. The assemblage of claim 16 wherein said polysiloxane has the formula:

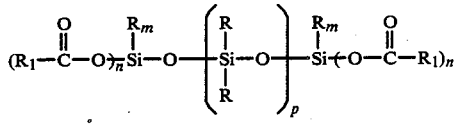

wherein n is an integer of from 1 to 3;

m is an integer of from 0 to 2;

n+m=3;

p is from about 10 to about 2000;

each R is independently a substituted or unsubstituted alkyl group having from 1 to about 18 carbon atoms or a substituted or unsubstituted aryl group having from about 6 to about 10 carbon atoms; and each $R_1$ is independently a substituted or unsubstituted alkyl group having from 1 to about 7 carbon atoms or a substituted or unsubstituted aryl group having from about 6 to about 10 carbon atoms.

18. The assemblage of claim 16 wherein said siloxane is a methydiacetoxy-terminated polydimethylsiloxane.

19. The assemblage of claim 18 wherein said polysiloxane has the formula:

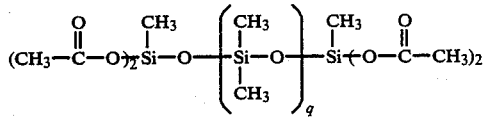

wherein q is from about 10 to about 2000.

20. The assemblage of claim 16 wherein said polysiloxane is present in an amount of from about 0.0005 to about 0.05 g/m$^2$ coated from a thermoplastic binder.

* * * * *